US010606215B2

(12) United States Patent
Alagon Carrillo

(10) Patent No.: US 10,606,215 B2
(45) Date of Patent: Mar. 31, 2020

(54) TIMEPIECE MECHANISM

(71) Applicant: Montres Breguet S.A., L'Abbaye (CH)

(72) Inventor: Sebastian Alagon Carrillo, Romainmotier (CH)

(73) Assignee: Montres Breguet S.A., L'Abbaye (CH)

( * ) Notice: Subject to any disclaimer, the term of this patent is extended or adjusted under 35 U.S.C. 154(b) by 119 days.

(21) Appl. No.: 15/972,285

(22) Filed: May 7, 2018

(65) Prior Publication Data

US 2018/0341224 A1 Nov. 29, 2018

(30) Foreign Application Priority Data

May 29, 2017 (EP) ..... 17173324

(51) Int. Cl.
*G04B 19/02* (2006.01)
*G04B 13/00* (2006.01)
(Continued)

(52) U.S. Cl.
CPC ..... *G04B 13/005* (2013.01); *G04B 5/14* (2013.01); *G04B 13/001* (2013.01); *G04B 19/02* (2013.01); *G04B 19/082* (2013.01)

(58) Field of Classification Search
CPC ..... G04B 13/00; G04B 13/005; G04B 5/14; G04B 13/001; G04B 19/02; G04B 19/05; G04B 19/082
(Continued)

(56) References Cited

U.S. PATENT DOCUMENTS 3,952,500 A * 4/1976 Tomura ..... G04B 45/0007 368/229
D357,883 S * 5/1995 Krauss ..... D10/122
(Continued)

FOREIGN PATENT DOCUMENTS

CH 694 175 A5 8/2004

OTHER PUBLICATIONS

European Search Report dated Nov. 8, 2017 in European Application 17173324.9.1 filed on May 29, 2017 (with English Translation of Categories of Cited Documents and Written Opinion).

*Primary Examiner* — Sean Kayes
(74) *Attorney, Agent, or Firm* — Oblon, McClelland, Maier & Neustadt, L.L.P.

(57) ABSTRACT

A timepiece mechanism including a deformable rhombus including four coplanar segments pivotally connected in pairs by their vertices, including an input segment adjacent to an output segment, both pivoted about a pivot axis perpendicular to the plane of the rhombus and passing through a first vertex common to the input and output segments and locked in translation in the plane of the rhombus, a lever mounted to pivot about the pivot axis, the lever being kinematically connected in rotation, about the pivot axis, to a second vertex of the rhombus, opposite to the first vertex, a first locking member movable between a first locking position, in which the lever is locked in rotation, and a first unlocking position in which the first locking member does not hinder rotation of the lever, a second locking member movable between a second locking position, in which the second vertex is locked in translation in a radial direction, and a second unlocking position in which the second locking member does not hinder radial movement of the second vertex.

14 Claims, 4 Drawing Sheets

(51) Int. Cl.
*G04B 5/14* (2006.01)
*G04B 19/08* (2006.01)

(58) Field of Classification Search
USPC ..... 368/238
See application file for complete search history.

(56) References Cited

U.S. PATENT DOCUMENTS

| | | | | |
|---|---|---|---|---|
| 7,293,911 | B2 * | 11/2007 | Bonvin | G04F 3/022 368/106 |
| 2015/0016232 | A1 * | 1/2015 | Graemiger | G04B 19/02 368/132 |
| 2018/0113420 | A1 * | 4/2018 | Winkler | G04B 17/04 |
| 2018/0341227 | A1 * | 11/2018 | Alagon Carrillo | G04B 19/266 |

* cited by examiner

TIMEPIECE MECHANISM

This application claims priority from European patent application No. 17173324.9 filed on May 29, 2017, the entire disclosure of which is hereby incorporated herein by reference.

FIELD OF THE INVENTION

The present invention relates to the field of horology. It more particularly concerns a timepiece mechanism capable of performing a mathematical operation.

BACKGROUND OF THE INVENTION

There are known reversers which allow the bidirectional rotational motion of the oscillating weight to be automatically transformed into a unidirectional rotational motion intended to wind the barrel. The present invention proposes to offer a reverser mechanism that is capable of transforming, on demand, an input function into an output function that varies similarly or inversely to the input function. To this end, the mechanism is able to provide an output value equal or opposite to an input value.

SUMMARY OF THE INVENTION

More precisely, the invention concerns a timepiece mechanism comprising:

- a deformable rhombus comprising four coplanar segments pivotally connected in pairs by their vertices, including an input segment adjacent to an output segment, both pivoted about a pivot axis perpendicular to the plane of the rhombus and passing through a first vertex which is common to the input and output segments and which is locked in translation in the plane of the rhombus,
- a lever mounted to pivot about the pivot axis, the lever being kinematically connected in rotation, about the pivot axis, to a second vertex of the rhombus, opposite to the first vertex,
- a first locking member capable of moving between a first locking position, in which the lever is locked in rotation about the pivot axis, and a first unlocking position in which the first locking member does not hinder rotation of the lever,
- a second locking member capable of moving between a second locking position, in which the second vertex is locked in translation in a radial direction relative to the pivot axis, and a second unlocking position in which the second locking member does not hinder radial movement of the second vertex, the mechanism being arranged such that one of the first and second locking members is in its locking position when the other of the first and second locking members is in its unlocking position,
- a control device capable of controlling the movement of the first locking member between its locking and unlocking positions.

Thus, since the angular position of the input segment represents the input value of the mechanism, the angular position of the output segment represents an output value that varies in a similar manner to the input value when the first locking member is in its unlocking position, and varies inversely to the input value when the first locking member is in its locking position.

The mechanism thus described allows an output value that is equal or opposite to the input value to be provided on demand.

According to an advantageous aspect of the invention, the mechanism comprises a first return means intended to hold the first locking member in abutment against the control device.

According to another advantageous aspect of the invention, the mechanism comprises a desmodromic link between the control device and the first locking member.

According to another advantageous aspect, the mechanism comprises a second return means intended to hold the second locking member in its locking position.

According to another advantageous aspect of the invention, the first locking member is arranged to move the second locking member into its unlocking position when the first locking member is moved into its locking position.

According to another advantageous aspect of the invention, the input segment is integral with a feeler arranged to follow the profile of a cam intended to be driven in rotation by a timepiece mechanism controlled by a timepiece movement or by a user.

According to another advantageous aspect of the invention, the output segment is integral with a toothed sector capable of transmitting the output value represented by the angular position of the output segment.

According to another advantageous aspect of the invention, the lever comprises an oblong opening extending in a radial direction relative to the pivot axis and at least partially housing a pin that pivotally connects the third and fourth segments of the rhombus by their vertex, formed by the second vertex.

According to another advantageous aspect of the invention, the second locking member is pivoted on the lever and comprises a hook that cooperates with the pin in order to lock the pin in translation in the radial direction.

According to another advantageous aspect of the invention, the first locking member is pivoted and comprises a notch that cooperates with the lever in order to block the lever in rotation about the pivot axis.

BRIEF DESCRIPTION OF THE DRAWINGS

Other details of the invention will appear more clearly upon reading the following description, made with reference to the annexed drawings, in which.

DETAILED DESCRIPTION OF A PREFERRED EMBODIMENT

Figure 1:
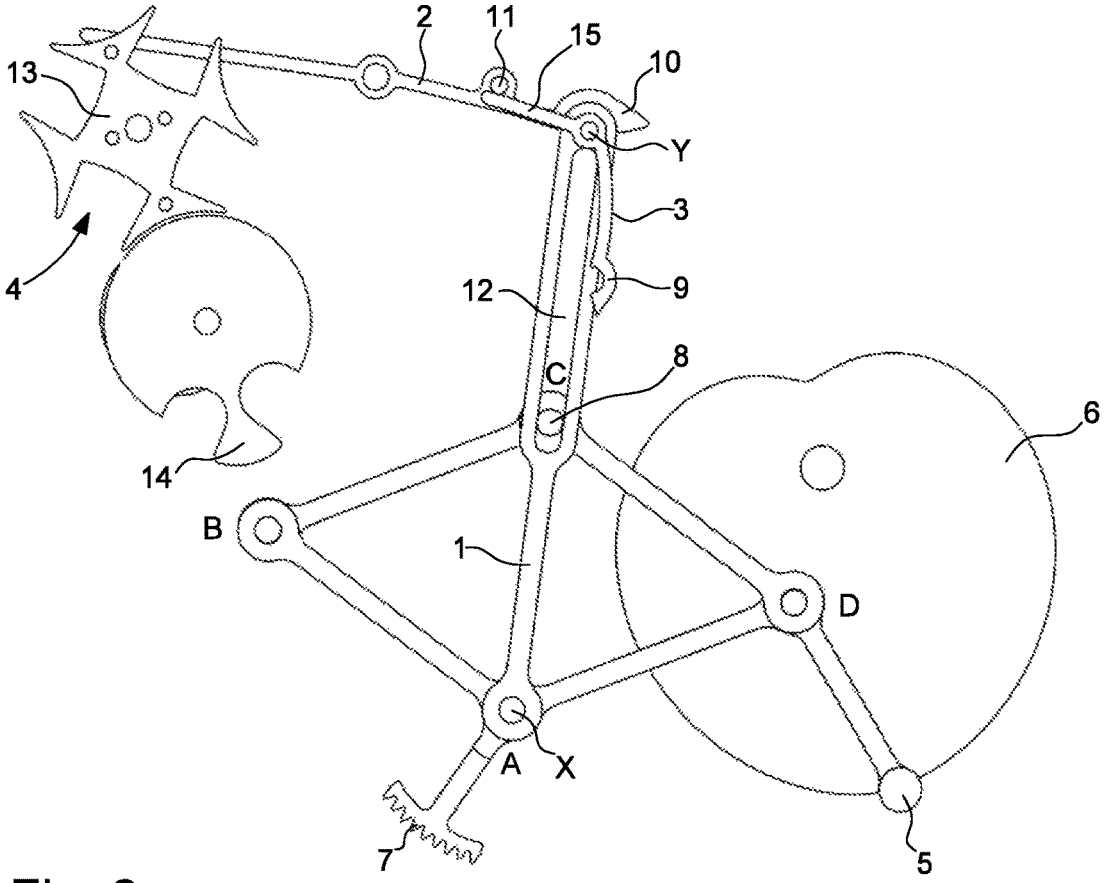
FIGS. 1 to 5 represent a first embodiment of a mechanism of the invention in different positions.
Figure 2:
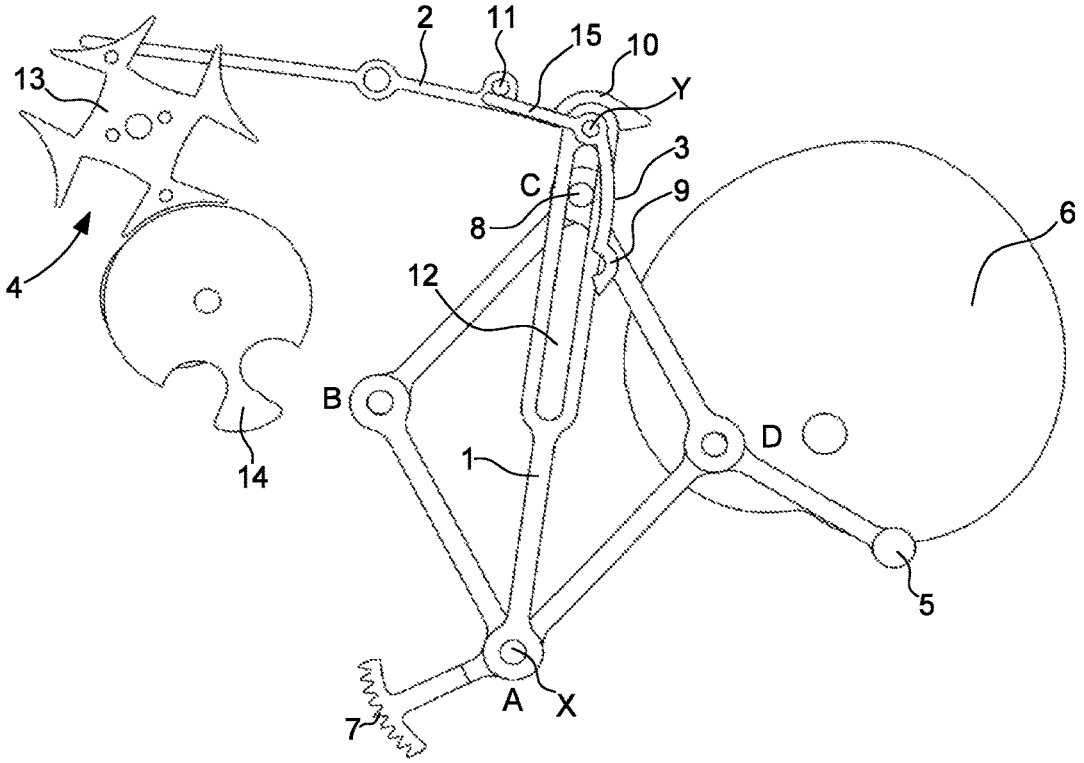
Figure 3:
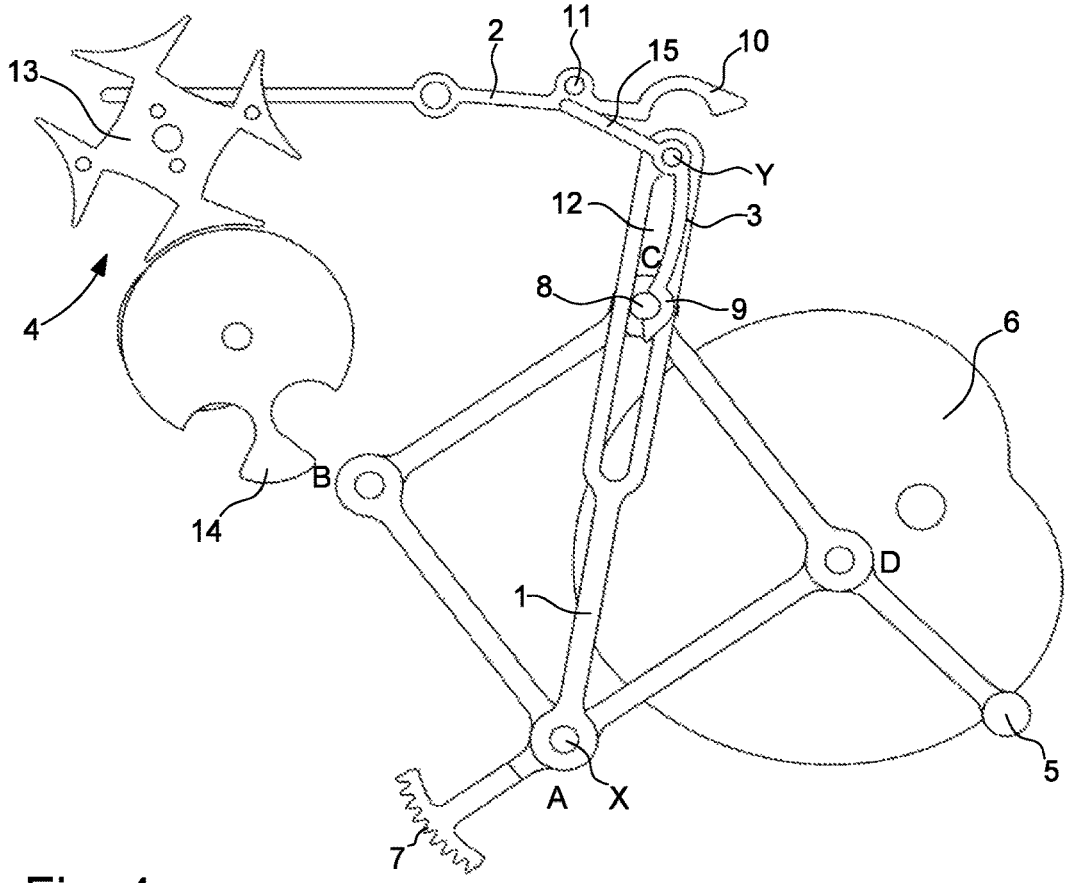
Figure 4:
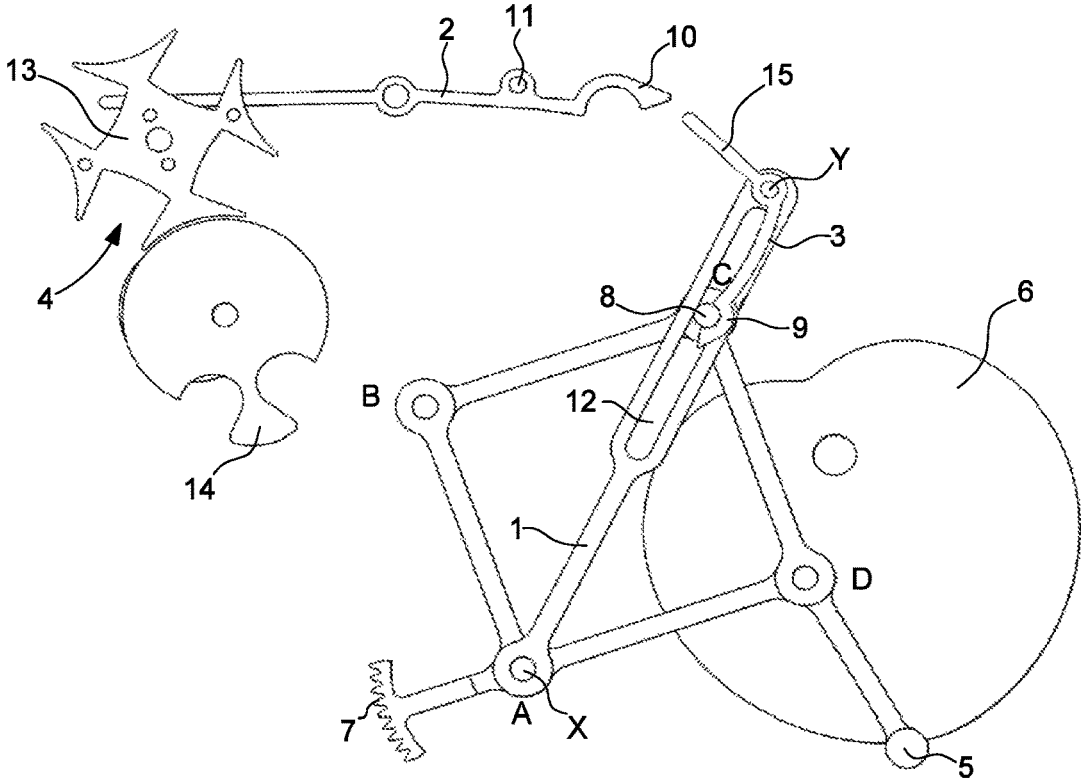
Figure 5:
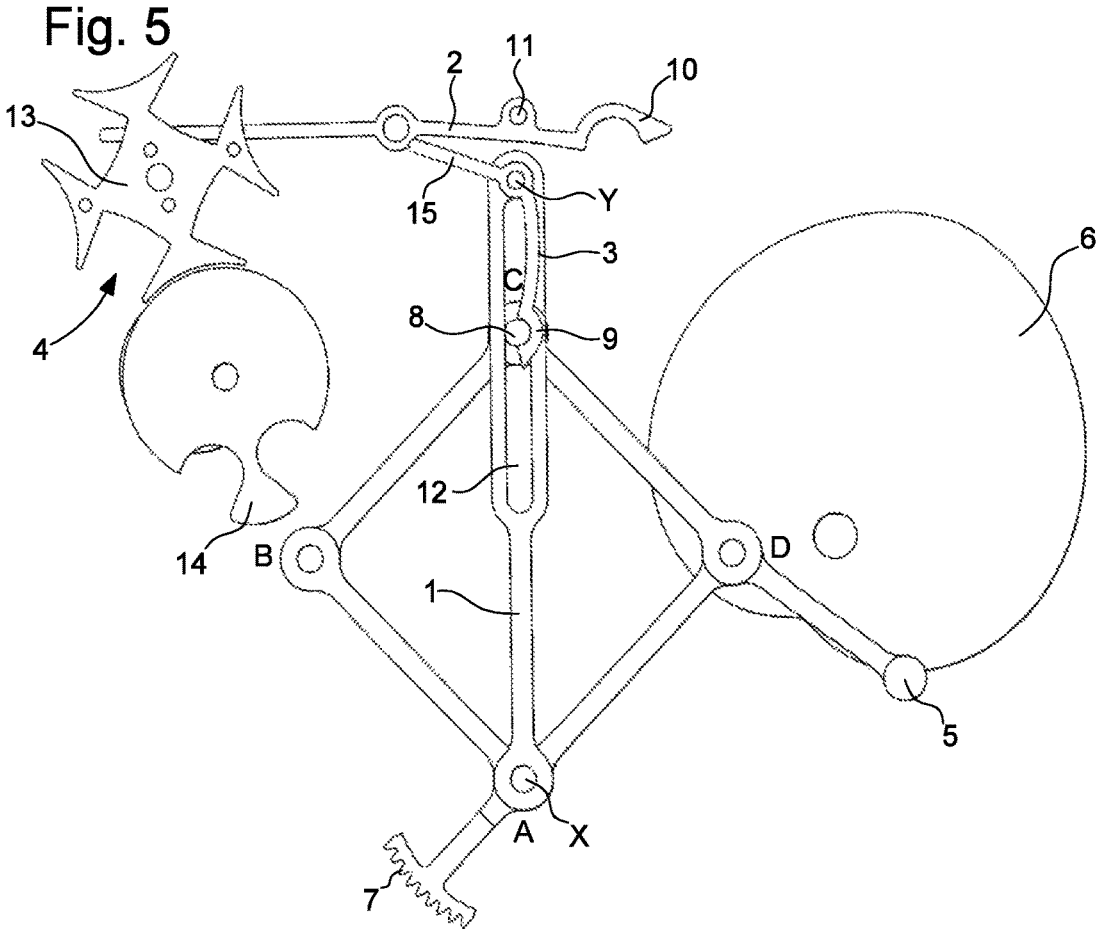

A first embodiment of a timepiece mechanism according to the invention is represented in different positions in FIGS. 1 to 5. The mechanism of the invention is intended to be mounted on a timepiece movement, either in an integrated manner or in a modular manner. The purpose of the mechanism is to transform, on demand, an input value into an output value that varies similarly or inversely to the input value. It is therefore capable of having two states: a reverser state as represented in FIGS. 1 and 2, and a follower state as represented in FIGS. 4 and 5. The particular position of the mechanism represented in FIG. 3 is that in which the mechanism is capable of changing state.

The mechanism comprises a deformable, rhombus-shaped structure ABCD, comprising four coplanar segments pivotally connected in pairs by their vertices. Rhombus ABCD includes an input segment AD adjacent to an output segment AB, both pivoted about a pivot axis X perpendicular to the plane of the rhombus and passing through a first vertex A, which is common to the input and output segments AD and AB and which is locked in translation in the plane of rhombus ABCD. This means that vertex A remains stationary, unlike the other three vertices which can move in the plane of rhombus ABCD.

The mechanism also comprises a lever 1 mounted to pivot about pivot axis X, lever 1 being kinematically connected in rotation, about pivot axis X, to a second vertex C of the rhombus, opposite to first vertex A. Lever 1 comprises an oblong opening 12 extending in a radial direction relative to pivot axis X and at least partially housing a pin 8 that pivotally connects third segment DC and fourth segment CB of the rhombus by their vertex, i.e. second vertex C. Oblong opening 12 has a width substantially equal to the diameter of pin 8 and forms a sliding guide in which pin 8 can slide. It is evident that any equivalent sliding guide connection system can be used, for example the oblong opening and the pin can be replaced by two pins flanking a parallel segment.

The mechanism also comprises a first locking member 2 in the form of a pivoting arm, one end of which is provided with a notch 10 arranged to cooperate with the end of lever 1. First locking member 2 is capable of moving between a first locking position, in which notch 10 covers the end of lever 1 so as to lock lever 1 in rotation about pivot axis X, and a first unlocking position, in which first locking member 2 does not hinder rotation of lever 1.

The mechanism also comprises a second locking member 3, pivoted at Y on lever 1, and one end of which comprises a hook 9 able to cooperate with pin 8 in order to lock pin 8 in translation in the radial direction. Second locking member 3 is capable of moving between a second locking position, in which second vertex C is locked in translation in a radial direction relative to pivot axis X, and a second unlocking position, in which second locking member 3 does not hinder radial movement of second vertex C.

The mechanism also comprises a first return means (not represented), intended to hold first locking member 2 resting against a control device 4, described hereinafter. Typically, the first return means is an elastic return means. As an alternative to a return means, a desmodromic link can be used between control device 4 and first locking member 2.

A second return means (not represented) is intended to hold second locking member 3 in its locking position, as represented in FIGS. 3 to 6. The action of the second return means allows the second locking member to lock pin 8 in translation in the radial direction. The second return means may, for example, be an elastic return means or a magnetic means.

The mechanism is arranged such that there is only ever one of first and second locking members 2, 3 in its locking position, the other of first and second locking members 2, 3 then being in its unlocking position. The mechanism is in its reverser state when the first locking member is locked, and in its follower state when the second member is locked. In other words, the movements of first and second locking members 2 and 3, which correspond to changes of state of the mechanism, are made in a synchronized manner. For this purpose, first locking member 2 comprises a stop 11 intended to cooperate with a lever arm 15 comprised in second locking member 3, to move second locking member 3 into its unlocking position when first locking member 2 moves into its locking position. Conversely, when first locking member 2 moves into its unlocking position, second locking member 3 moves into its locking position under the action of the second return means.

The mechanism also comprises a control device 4, which is capable of controlling the movement of first locking member 2 between its locking and unlocking positions. Control device 4 is made here using a Maltese cross 13, driven in rotation by an indexing finger 14 which, in turn, is intended to be driven by the movement. The movement of first locking member 2 by control device 4 occurs when lever 1 and pin 8 are in a particular position, called the 'permutation position', as represented in FIG. 3.

The angular position of input segment AD is determined by the movement of a feeler 5, integral with input segment AD, and arranged to follow the profile of a cam 6 which is intended to be driven in rotation by a timepiece movement. Alternatively, input segment AD could also be integral with a first toothed sector able to receive the input value represented by the angular position of input segment AD.

Output segment AB is integral with a second toothed sector 7 able to mesh with a toothed wheel or a rack to transmit the output value of the mechanism.

Figure 6:
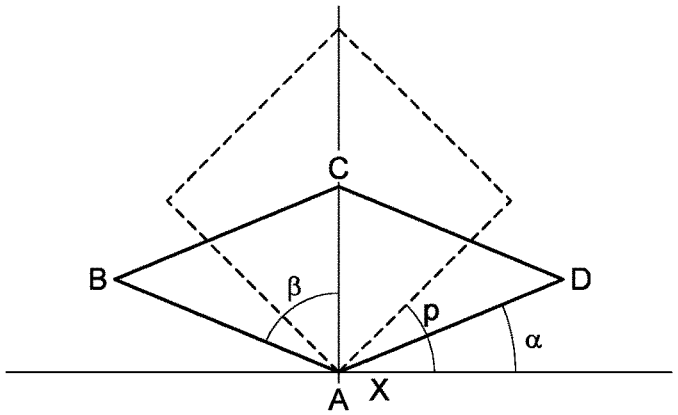
FIG. 6 represents a schematic view of the mechanism in the reverser state.

FIG. 6 represents a schematic diagram of the mechanism in its reverser state, with the diagonal AC of rhombus ABCD locked in rotation about pivot axis X. The angular position $\alpha$ of input segment AD represents the input value of the mechanism, whereas the output value is represented by the angular position $\beta$ of output segment AB. In the first embodiment shown, permutation value p corresponds to values of 45° for angles $\alpha$ and $\beta$, which means that rhombus ABCD is a square when the mechanism is in its follower state.

When the mechanism is in the follower state, i.e. when first locking member 2 is in its unlocking position, rhombus ABCD pivots integrally about pivot axis X, so that the output value varies in a similar manner to the input value. With the reference marks selected for FIG. 6, output value $\beta$ is equal to input value $\alpha$.

When the mechanism is in the reverser state represented in FIG. 6, i.e. when first locking member 2 is in its locking position, output value $\beta$ varies inversely to input value $\alpha$. The change of state occurs at permutation value p, which is not necessarily zero. The output value is thus expressed: $\beta=2p-\alpha$. In the particular case where permutation value p is zero, output value $\beta$ is the opposite of input value $\alpha$.

The output value can be transmitted via second toothed sector 7 to another mechanism or to a display device. Alternatively, it is possible to provide a display means such as a guide-mark, integral with output segment AB and capable of indicating the output value represented by the angular position of output segment AB.

Figure 7:
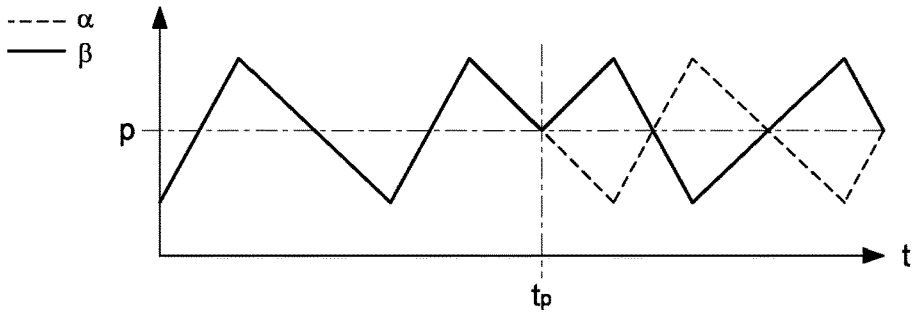
FIG. 7 shows a graph of the input and output functions of the mechanism.

In the first embodiment, as the permutation of the mechanism from one state to the other can only occur at permutation value p in the configuration of FIG. 3, it is preferable for control device 4 to be synchronized with the movement of cam 6. FIG. 7 gives an illustration of the inversion of a function by the reverser mechanism. The change of state occurs at an instant $t_p$. The left part of the graph corresponds to the follower state in which input value $\alpha$ coincides with output value $\beta$. The left part of the graph corresponds to the reverser state in which output value β varies inversely to input value α around permutation value p.

Figure 8:
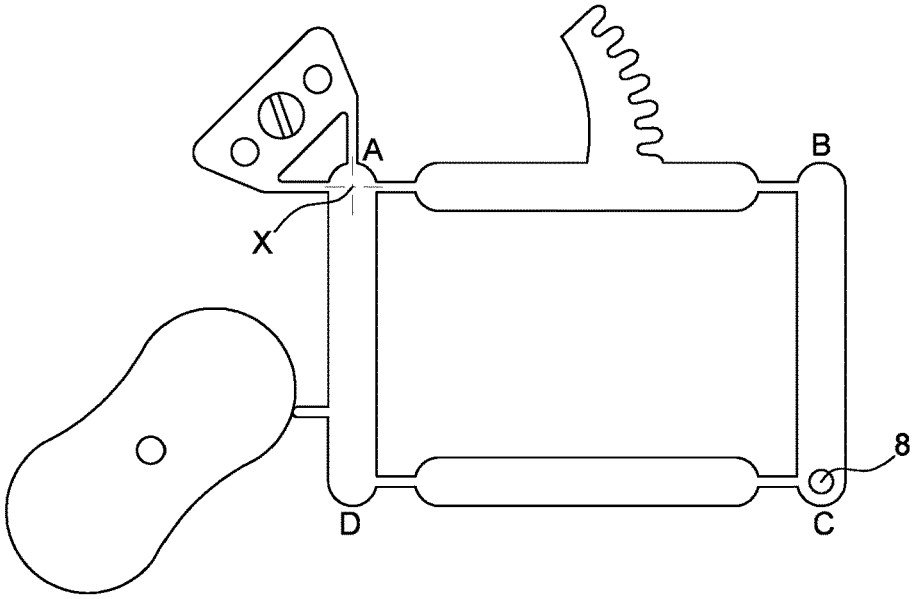
FIG. 8 represents a variant of the first embodiment.

According to a variant represented in FIG. 8, rhombus ABCD is formed in one piece, with each segment of the rhombus connected to the adjacent segments by flexible elements acting as pivots. In this variant, pivot axis X is also a virtual pivot axis formed by two deformable flexible arms connecting input segment AD to a fixed base. Likewise, lever 1 and the first and second locking members 2, 3 can also be pivoted using virtual pivots. The present invention covers all combinations relying on physical pivots or virtual pivots.

Figure 9A:
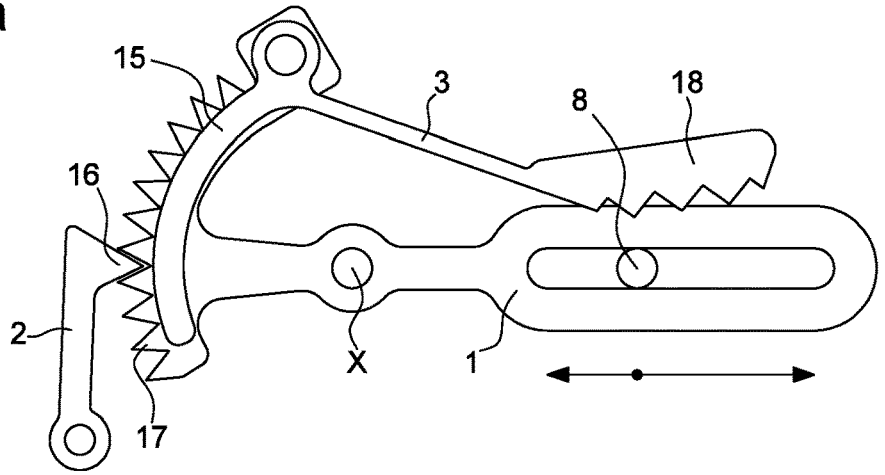
FIGS. 9*a* and 9*b* represent the lever and the first and second locking members of a second embodiment of the invention.
Figure 9B:
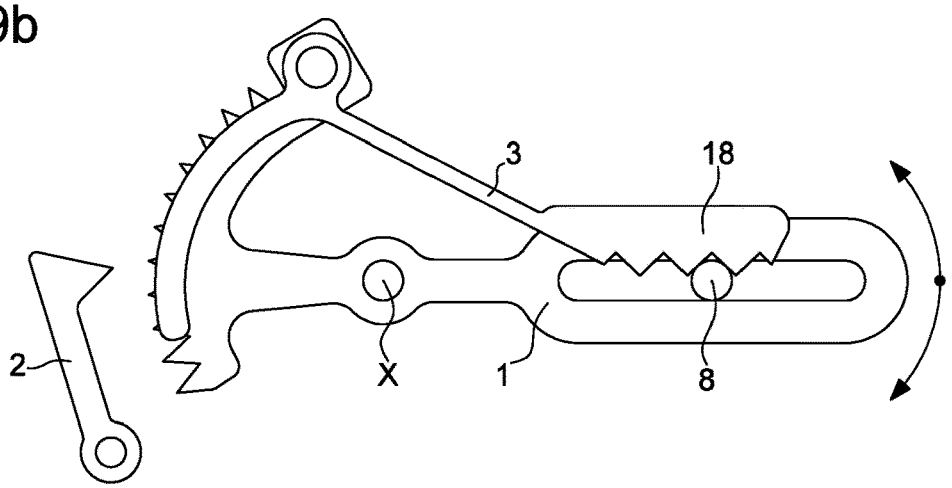

FIGS. 9*a* and 9*b* represent lever 1 and the first and second locking members 2, 3 of a second embodiment of the invention. Unlike the first embodiment presented, permutation value p is variable here.

FIG. 9*a* corresponds to the reverser state of the mechanism in which locking member 2 is in its locking position. First locking member 2 comprises a tip 16 that lodges between two teeth of a toothing 17 integral with lever 1. On penetrating toothing 17, tip 16 presses on a lever arm 15 comprised in second locking member 3, which holds it in its unlocking position in which pin 8 is free to move radially relative to pivot axis X.

FIG. 9*b* corresponds to the follower state in which second locking member 3 is in its locking position. Second locking member comprises a rack 18 whose toothing cooperates with pin 8 to lock the pin in translation when first locking member 2 is placed in its unlocking position.

In the second embodiment shown in FIGS. 9*a* and 9*b*, the first and second locking members 2, 3 comprise a plurality of notches or respectively hooks. Thus, the input value at which the movement of locking members 2, 3 between their locking and unlocking positions occurs, called the permutation value, is variable. Adjustment can be made by the timepiece movement or by the user via a suitable adjustment device. The permutation values have values here that vary in discrete steps, but it is also possible to envisage a continuous variation by reducing the step value.

Thus, the mechanism according to the invention allows selective inversion of an input function to be achieved. Numerous applications of this mechanism can be envisaged.

A retrograde display can alternate its movement. To facilitate the reading of information, the guide-mark means of the retrograde display can change together with the permutation.

A push button correction device can act in both directions of correction according to the state in which it is chosen to place the mechanism, with permutation occurring when the correction device is at rest.

The present invention is not limited to the illustrated example and is capable of various variants and modifications that will be evident to those skilled in the art. Thus, for example, the roles of segments AD and AB may be reversed, with segment AD then being an output segment and segment AB being an input segment.

What is claimed is:

1. A timepiece mechanism, wherein the mechanism comprises:

a deformable rhombus comprising four coplanar segments pivotally connected in pairs by their vertices, including an input segment adjacent to an output segment, both pivoted about a pivot axis perpendicular to a plane of the rhombus and passing through a first vertex which is common both to the input segment and to the output segment and which is locked in translation in the plane of the rhombus, a lever mounted to pivot about the pivot axis, the lever being kinematically connected in rotation, about the pivot axis, to a second vertex of the rhombus, opposite to the first vertex, a first locking member capable of moving between a first locking position, wherein the lever is locked in rotation about the pivot axis, and a first unlocking position wherein the first locking member does not hinder rotation of the lever, a second locking member capable of moving between a second locking position, wherein the second vertex is locked in translation in a radial direction relative to the pivot axis, and a second unlocking position wherein the second locking member does not hinder radial movement of the second vertex, the mechanism being arranged such that one of the first locking member and the second locking member is in its locking position when the other of the first locking member and the second locking members is in its unlocking position, a control device capable of controlling movement of the first locking member between its first locking position and its first unlocking position, and wherein an angular position of the output segment represents an output value that varies in a similar manner to an input value when the first locking member is in its first unlocking position, and varies inversely to said input value when the first locking member is in its first locking position, the input value being represented by an angular position of the input segment.

2. The mechanism according to claim 1, wherein the mechanism comprises a first return means intended to hold the first locking member in abutment against the control device.

3. The mechanism according to claim 1, wherein the mechanism comprises a desmodromic link between the control device and the first locking member.

4. The mechanism according to claim 1, wherein the mechanism comprises a second return means intended to hold the second locking member in its second locking position.

5. The mechanism according to claim 1, wherein the first locking member is arranged to move the second locking member into its second unlocking position when the first locking member is moved into its first locking position.

6. The mechanism according to claim 1, wherein the input segment is integral with a feeler arranged to follow a profile of a cam intended to be driven in rotation by a timepiece movement or by a user.

7. The mechanism according to claim 1, wherein the input segment is integral with a first toothed sector capable of receiving the input value represented by the angular position of the input segment.

8. The mechanism according to claim 1, wherein the output segment is integral with a second toothed sector capable of transmitting the output value represented by the angular position of the output segment.

9. The mechanism according to claim 1, wherein the mechanism comprises a guide-mark, integral with the output segment and capable of indicating the output value represented by the angular position of the output segment.

10. The mechanism according to claim 1, wherein the lever comprises an oblong opening extending in a radial direction relative to the pivot axis and at least partially housing a pin that pivotally connects a third segment and a fourth segment of the rhombus by their vertex, formed by the second vertex.

11. The mechanism according to claim 10, wherein the second locking member is pivoted on the lever and comprises a hook that cooperates with the pin in order to lock the pin in translation in the radial direction.

12. The mechanism according to claim 11, wherein the first locking member and the second locking member comprise a plurality of notches or respectively hooks.

13. The mechanism according to claim 1, wherein the first locking member is pivoted and comprises a notch that cooperates with the lever in order to block the lever in rotation about the pivot axis.

14. The mechanism according to claim 1, wherein the input value, at which the movement of the first locking member and of the second locking member between their locking and unlocking positions occurs, is variable.

* * * * *